US008651332B2

(12) United States Patent
Pauze et al.

(10) Patent No.: US 8,651,332 B2
(45) Date of Patent: Feb. 18, 2014

(54) CONTAINER FOR RETAINING LIQUIDS AND METHOD OF USING THE SAME

(75) Inventors: Adam Pauze, Aurora (CA); Robert G. Dickie, King (CA)

(73) Assignee: Adam Pauze, Aurora, Ontario (CA)

( * ) Notice: Subject to any disclaimer, the term of this patent is extended or adjusted under 35 U.S.C. 154(b) by 73 days.

(21) Appl. No.: 13/369,891

(22) Filed: Feb. 9, 2012

(65) Prior Publication Data

US 2013/0206790 A1 Aug. 15, 2013

(51) Int. Cl.
*B65D 25/16* (2006.01)

(52) U.S. Cl.
USPC ..... 222/105

(58) Field of Classification Search
USPC ..... 222/105, 530, 109, 465.1; 220/495.11, 220/495.08, 908.1, 601, 604, 669, 671, 220/752; 29/428
See application file for complete search history.

(56) References Cited

U.S. PATENT DOCUMENTS 3,606,962 A * 9/1971 Scholle ..... 222/105
3,799,400 A * 3/1974 Fleury ..... 222/83.5
3,809,290 A * 5/1974 Schmit ..... 222/88
4,247,020 A * 1/1981 Desjardins ..... 222/83.5
4,576,310 A * 3/1986 Isgar et al. ..... 220/495.1
4,653,671 A * 3/1987 Duffy et al. ..... 222/105
4,671,427 A * 6/1987 Farquharson ..... 222/83.5
2008/0197136 A1* 8/2008 Dukes ..... 220/495.11
2010/0200613 A1* 8/2010 Smith et al. ..... 222/105
2011/0272409 A1* 11/2011 Kasbohm ..... 220/495.11
2012/0037636 A1* 2/2012 Ratzlaff ..... 220/495.08

* cited by examiner

*Primary Examiner* — Paul R Durand
*Assistant Examiner* — Donnell Long
(74) *Attorney, Agent, or Firm* — Sand & Sebolt

(57) ABSTRACT

A jug for retaining a plastic bag containing a liquid and a method of using the same. The jug includes a bottom and a peripheral wall extending upwardly therefrom and defining a cavity for receiving the bag. The peripheral wall terminates in a rim and a handle extends outwardly from the peripheral wall's exterior surface. An engagement means is provided on the jug to engage the bag and retain it within the cavity when the jug is tilted to pour the liquid therefrom. The engagement means preferably is a slit defined in the rear region of the peripheral wall adjacent the handle. The slit originates in the rim and extends downwardly for a distance. A portion of a rear region of the bag is slid into the slit and wedged therein. The wedged portion extends into a compartment defined by a retaining wall that extends outwardly from the peripheral wall.

17 Claims, 15 Drawing Sheets

CONTAINER FOR RETAINING LIQUIDS AND METHOD OF USING THE SAME

BACKGROUND OF THE INVENTION

1. Technical Field

This invention relates generally to containers for liquids. More particularly, this invention relates to container for holding a bag filled with a liquid such as milk. Specifically, this invention is directed to a milk jug which includes a slit into which a region of a plastic milk bag is engaged in order to substantially prevent the bag from sliding forwardly toward a front surface of the jug or from sliding out of the jug when it is tilted to pour milk from the same.

2. Background Information

A large percentage of the milk sold around the world is packaged in one liter plastic bags. These bags are then packaged in groups of three or four into a larger plastic bag. When the consumer gets the bagged milk home, a single one liter bag is removed from the larger bag and is slid into a jug that is complementary in size and includes a handle. The height of the jug allows the top of the bag to extend approximately 1"-2" above the upper rim of the jug. With scissors or a knife, the user cuts off a small part of the corner of the bag opposite the handle and thus creates a spout for pouring. The jug provides support for the bag. However, when the bag is relatively full and the jug is tipped, there is a tendency for the bag to slide toward the interior wall of the jug opposite the handle. As it does so, a small quantity of milk tends to splash out of the hole and be projected for a distance away from the jug. Obviously, this causes a mess for the consumer. Additionally, when the bag becomes fairly empty, the jug has to be tipped to a greater degree and this movement tends to cause the bag to begin to slide out of the jug's interior creating a mess.

There is therefore a need in the art for an improved container for retaining plastic bags of liquid.

BRIEF SUMMARY OF THE INVENTION

The device of the present invention comprises a jug configured to receive a bag of liquid therein and a method for using the same. The jug includes a mechanism for engaging and securing a portion of the bag therein to resist the tendency of the bag to slide forwardly toward the interior surface of the wall opposite the handle and to resist the tendency of the bag to slide out of the jug when it is tipped to pour liquid from the bag.

The jug includes a bottom wall and a peripheral wall extending upwardly therefrom and defining a cavity for receiving the bag. The peripheral wall terminates in a rim and a handle extends outwardly from the exterior surface of the peripheral wall. The engagement means provided on the jug preferably is a slit defined in the rear region of the peripheral wall adjacent the handle. The slit originates in the rim and extends downwardly for a distance and preferably is V-shaped being wider adjacent the rim and narrower remote therefrom. A portion of a rear region of the bag is slid into the slit and wedged therein. The wedged portion extends into a compartment defined by a retaining wall that extends outwardly from the peripheral wall.

BRIEF DESCRIPTION OF THE SEVERAL VIEWS OF THE DRAWINGS

A preferred embodiment of the invention, illustrated of the best mode in which Applicant contemplates applying the principles, is set forth in the following description and is shown in the drawings and is particularly and distinctly pointed out and set forth in the appended claims.

Similar numbers refer to similar parts throughout the drawings.

DETAILED DESCRIPTION OF THE INVENTION

Figure 1:
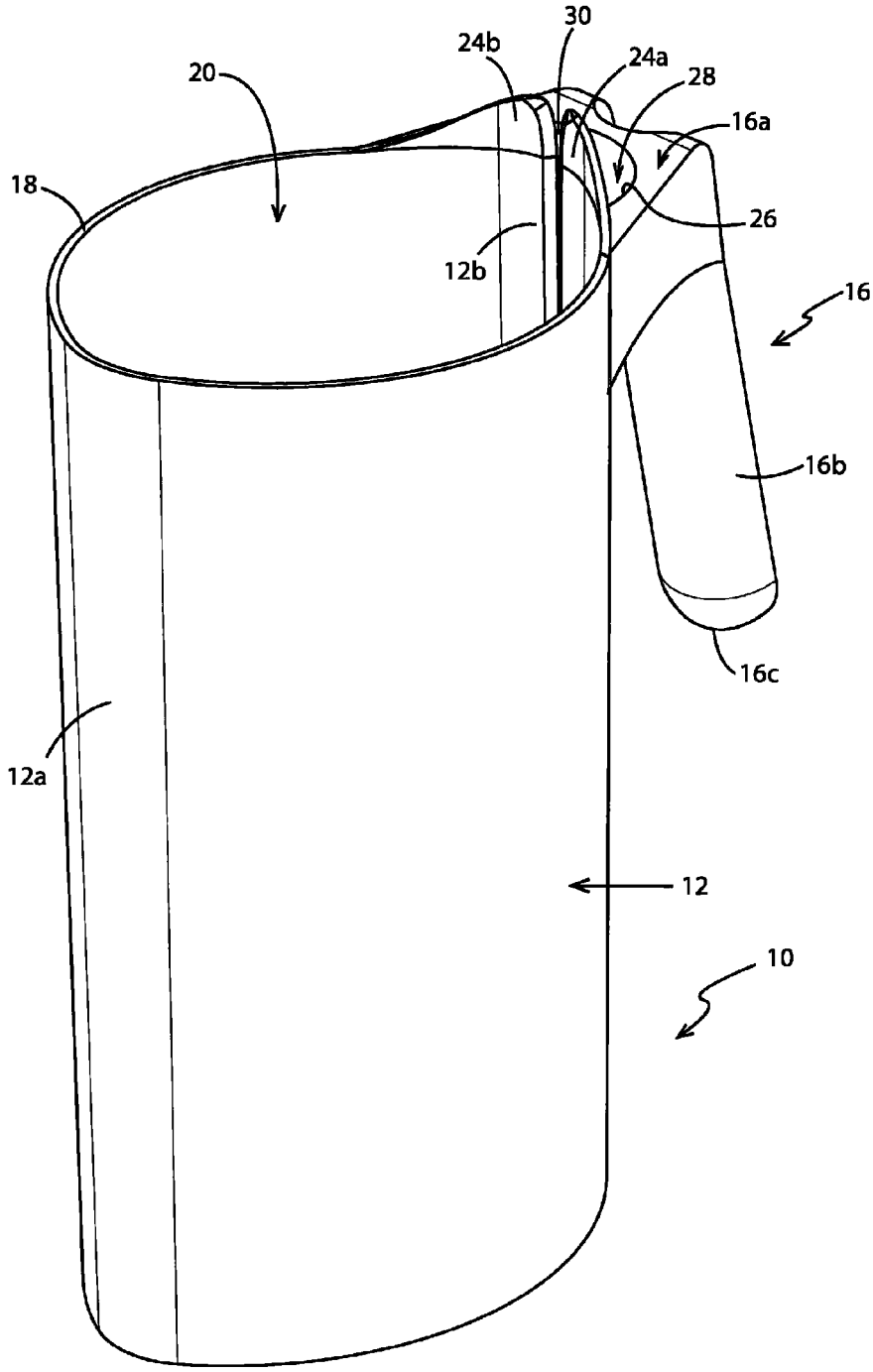
FIG. 1 is a front perspective view of a milk jug in accordance with the present invention.

Referring to FIGS. 1-15, there is shown a jug in accordance with the present invention, generally indicated at 10. Jug 10 preferably is manufactured by injection molding polypropylene and includes a peripheral wall 12, a bottom wall 14, and a handle 16. The polypropylene is a relatively flexible material. Preferably, peripheral wall 12 is generally elliptical in shape when viewed from above and has a front region 12*a* and a rear region 12*b*. Peripheral wall 12 further includes a rim 18. Peripheral wall 12 and bottom wall 14 bound and define a cavity 20 which is accessible through an opening defined by rim 18. Jug 10 is configured to receive a plastic bag 32 (FIG. 8) containing a liquid, such as milk, in cavity 20. In accordance with the present invention, jug 10 is provided with an engagement means which engages the liquid-containing bag and retains the same within cavity 20 when jug 10 is tilted to pour the liquid from the bag. The engagement means will be more fully described hereinafter.

Figure 2:
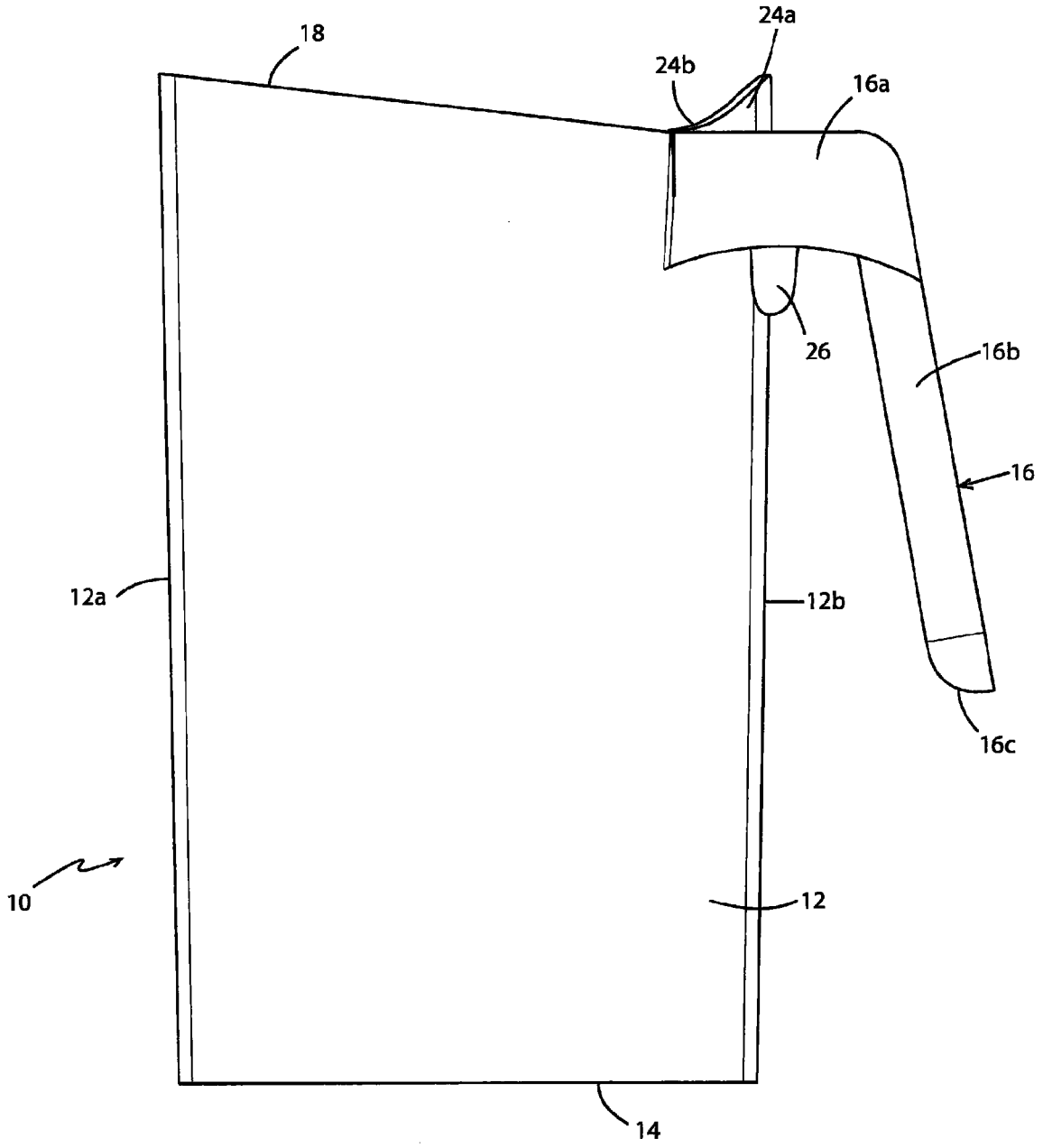
FIG. 2 is a left side view of the milk jug of FIG. 1.
Figure 3:
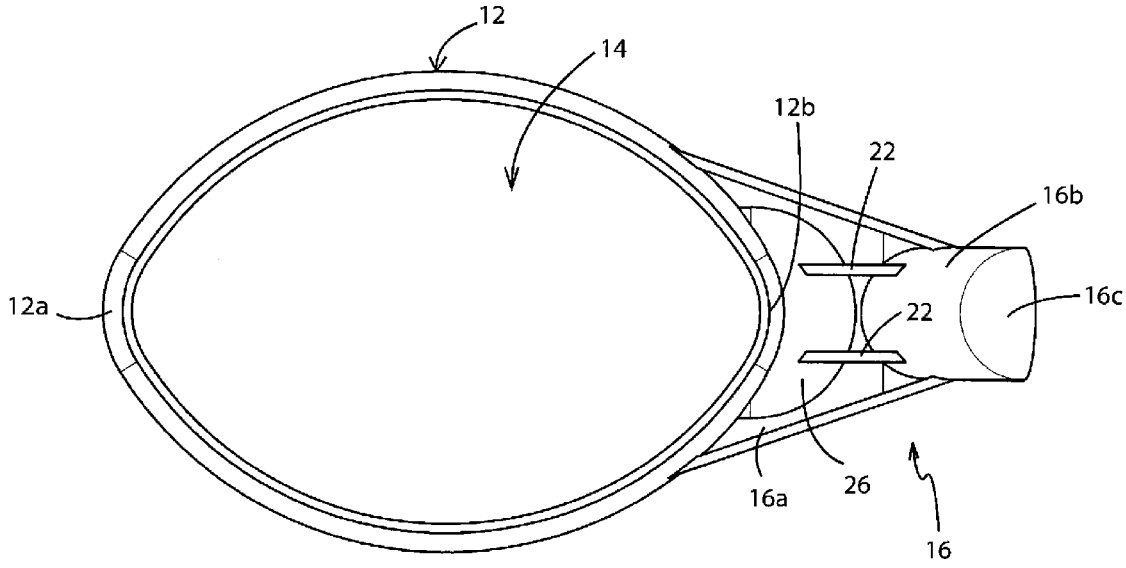
FIG. 3 is a bottom view of the milk jug of FIG. 1.
Figure 4:
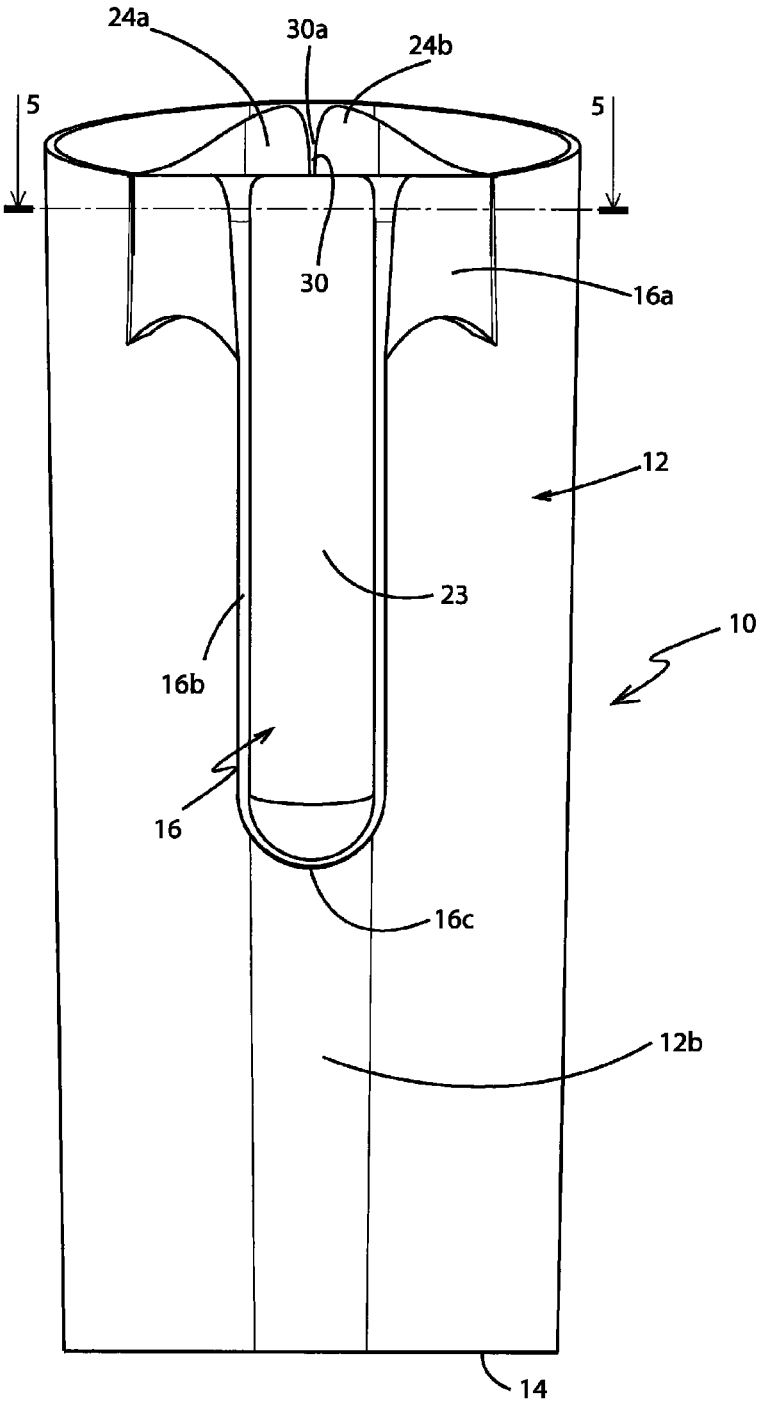
FIG. 4 is a rear view of the milk jug of FIG. 1.
Figure 5:
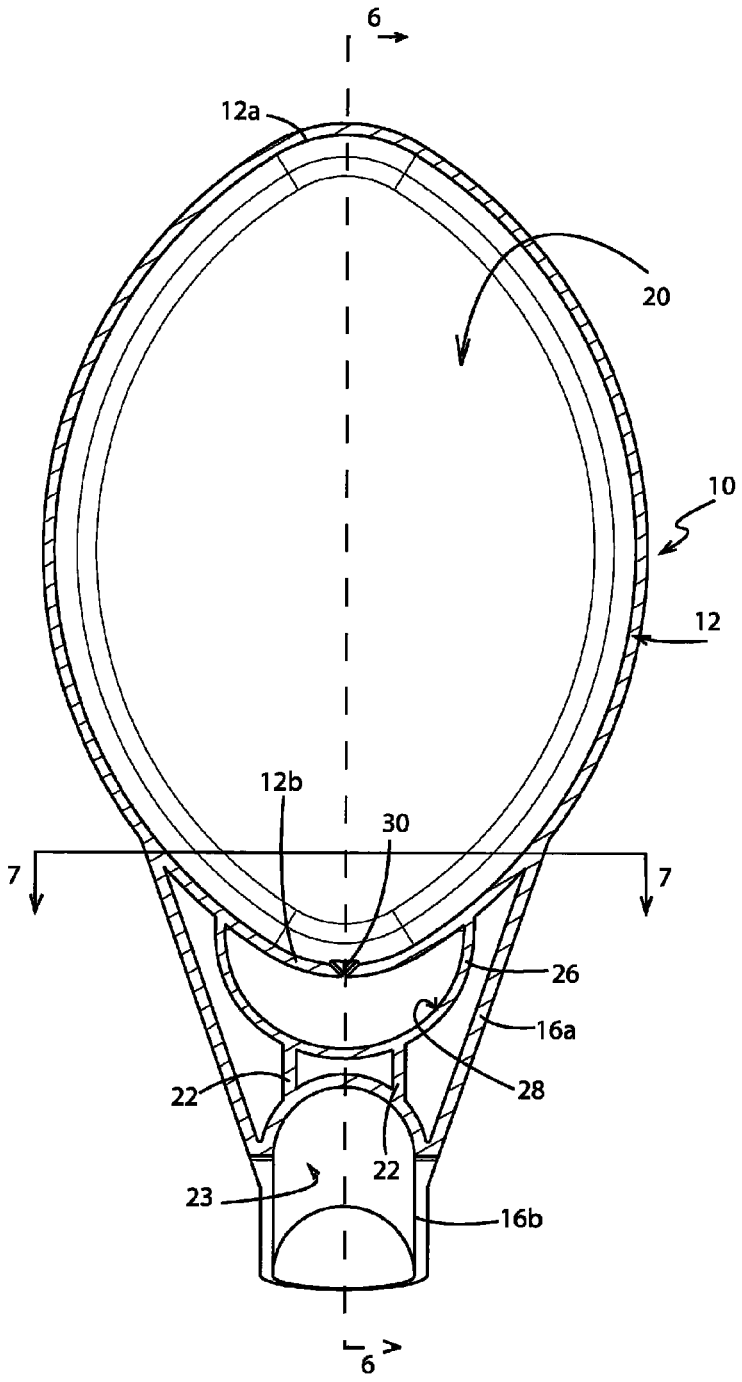
FIG. 5 is a top cross-sectional view of the milk jug taken along line 5-5 of FIG. 4.

FIGS. 1-4 illustrate that jug 10 includes a handle 16 which extends outwardly from an exterior surface of rear region 12*b* of peripheral wall 12. Handle 16 includes a generally horizontal top member 16*a* and a generally vertical leg member 16*b* which extends downwardly from top member 16*a* and at an angle relative thereto. As shown in FIG. 3, one or more bracing members 22 extend between the underside of top region 16*a* and a front portion of leg member 16*b*. FIG. 4 shows that top member 16*a* flares outwardly from leg member 16*b* to top member's engagement with peripheral wall 12. The flaring of top member 16*a* and the provision of bracing members 22 provides the strength and stability to handle 16 necessary to prevent the handle from bending or breaking off jug 10. Handle 16 preferably is also provided with a groove 23 which runs from proximate top member 16*a* to a short distance from bottom end 16*c* of handle 16. Groove 23 is generally semi-circular in cross-sectional shape and is configured to receive a thumb of the user therein. Thus, groove 23 aids in the user better being able to grip jug 10.

In accordance with a specific feature of the present invention, the engagement means for securing plastic bag 32 in cavity 20 of jug 10 includes a slit 30, at least one, and preferably two, buttresses 24*a*, 24*b*, and a retaining wall 26. Each of these components will be described further herein.

Rim 18 angles downwardly from proximate front region 12*a* of peripheral wall 12 to the areas where top member 16*a* of handle joins peripheral wall 12. This is shown in FIG. 2. A region of rim 18 adjacent top member 16*a* of handle and rear region 12*b* of peripheral wall 12 is formed into the two buttresses 24*a*, 24*b*. The first buttress 24*a* is disposed on a first side of the wider portion 30*a* of slit 30 and includes a curved upper edge 25*a* and an interior side surface 27*a* which angles downwardly toward slit 30. The second buttress 24*b* is disposed on a second and opposite side of wider portion 30*a* of slit 30. Second buttress 24*b* also includes a curved upper edge 25*b* and an interior side surface 27*b* which angles downwardly toward slit 30. The curved upper edge 25*a* and interior side surface 27*a* of first buttress 24*a* are substantially continuous with each other, and the curved upper edge 25*b* and interior side surface 27*b* of second buttress 24*b* are substantially continuous with each other.

The upper edges 25*a*, 25*b* of each buttress 24*a*, 24*b* curves gently upwardly away from the area where top member 16*a* of handle joins peripheral wall. As will be apparent from FIG. 6, the upper edges 25*a*, 25*b* of buttresses 24*a*, 24*b* are generally horizontally aligned with the portion 18*a* of rim 18 proximate front region 12*a* of peripheral wall 12.

Figure 6:
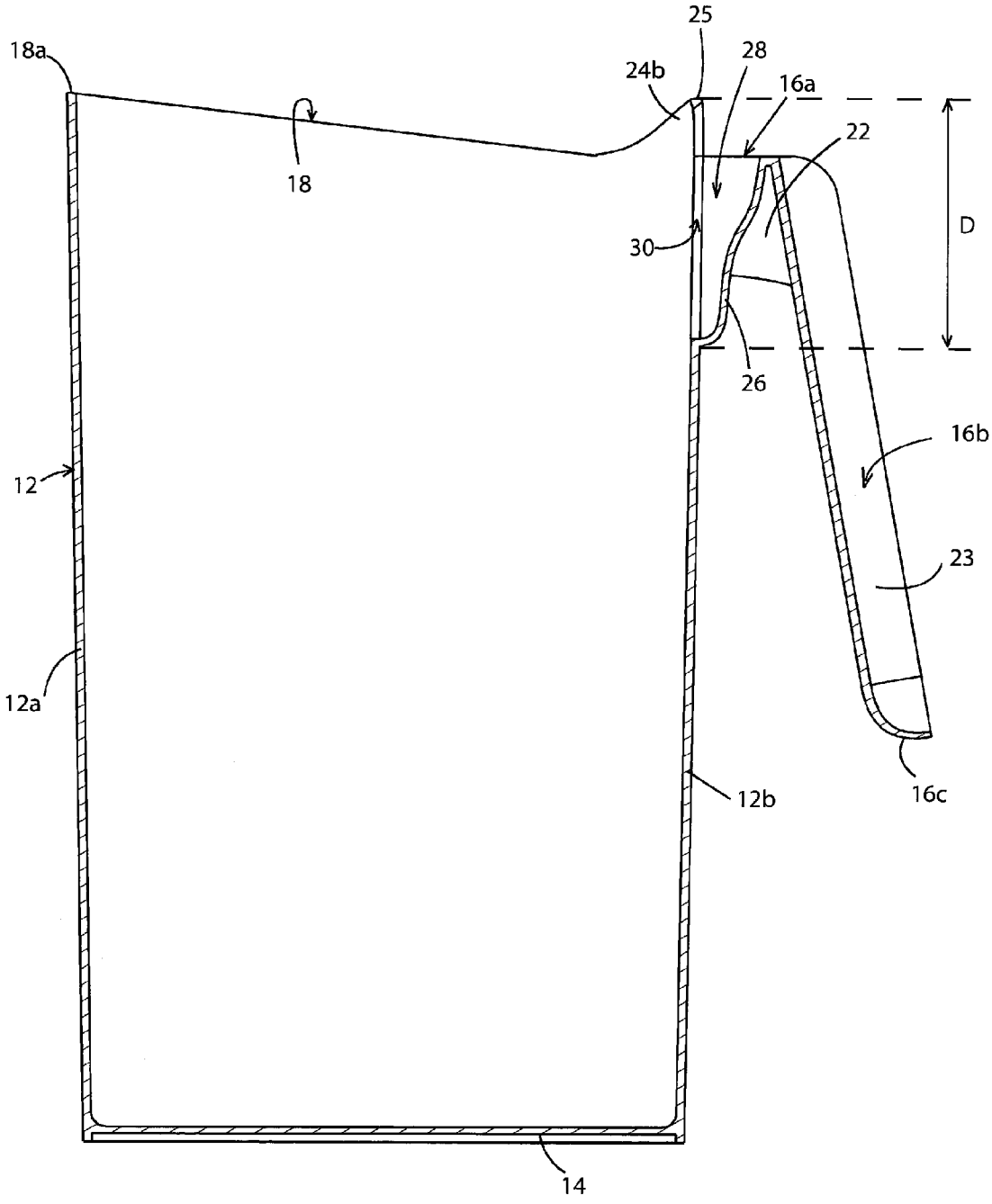
FIG. 6 is a left side cross-sectional view of the milk jug taken along line 6-6 of FIG. 5.
Figure 7:
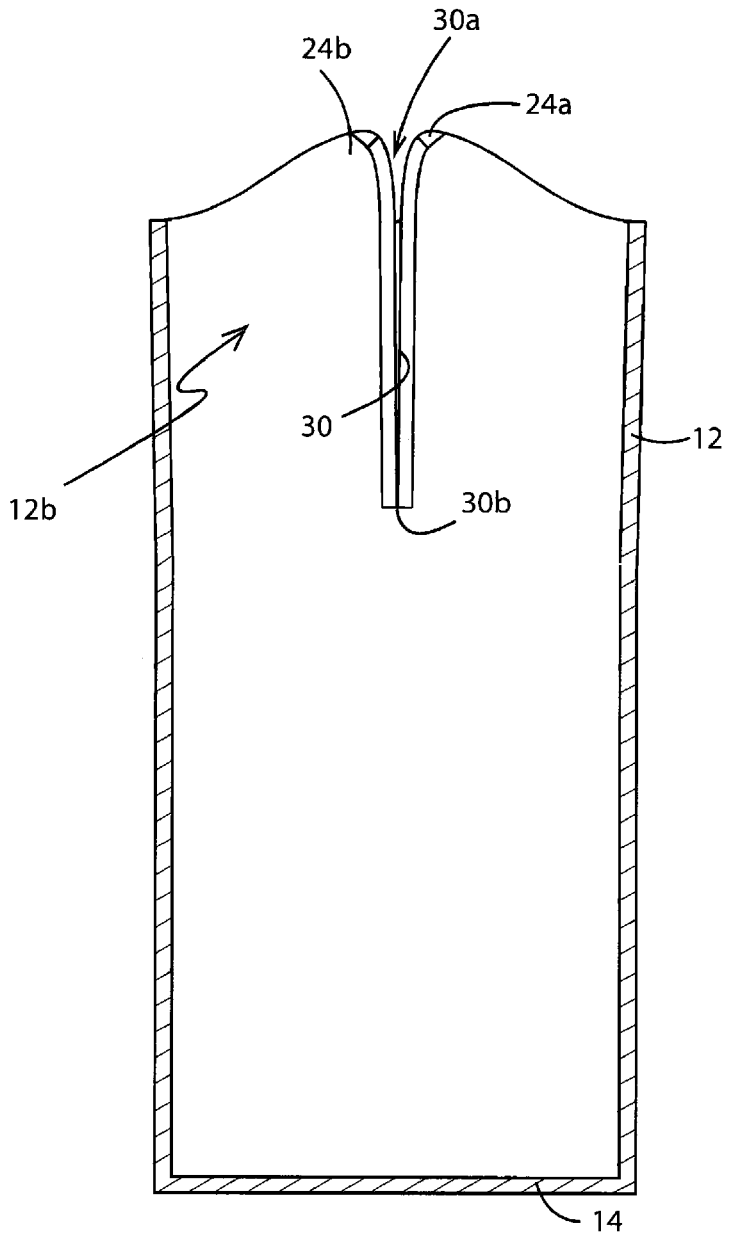
FIG. 7 is a front cross-sectional view of the milk jug taken along line 7-7 of FIG. 5.
Figure 8:
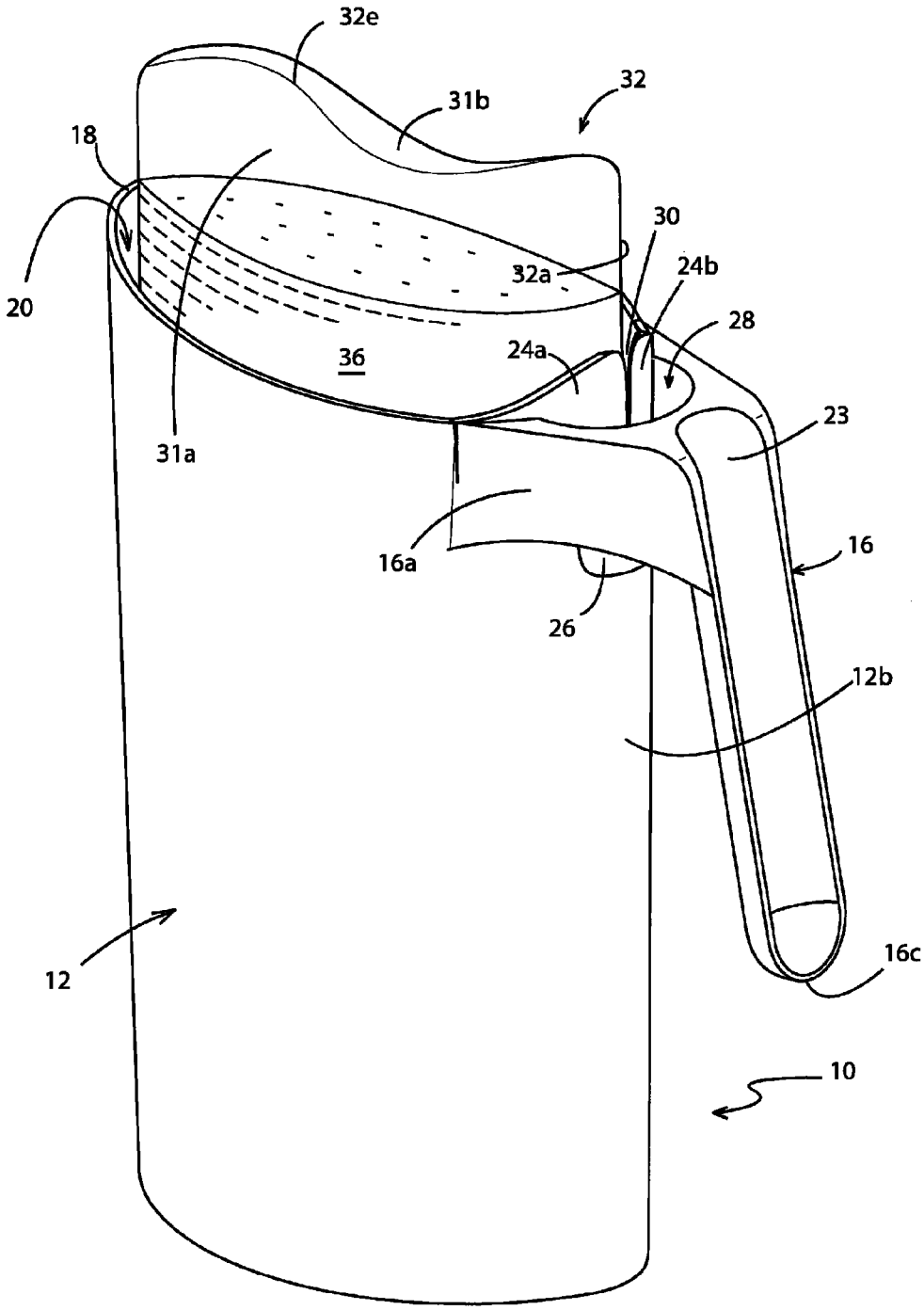
FIG. 8 is a rear perspective view of the milk jug having a milk bag disposed therein and with the bag shown in an unsecured position.
Figure 9:
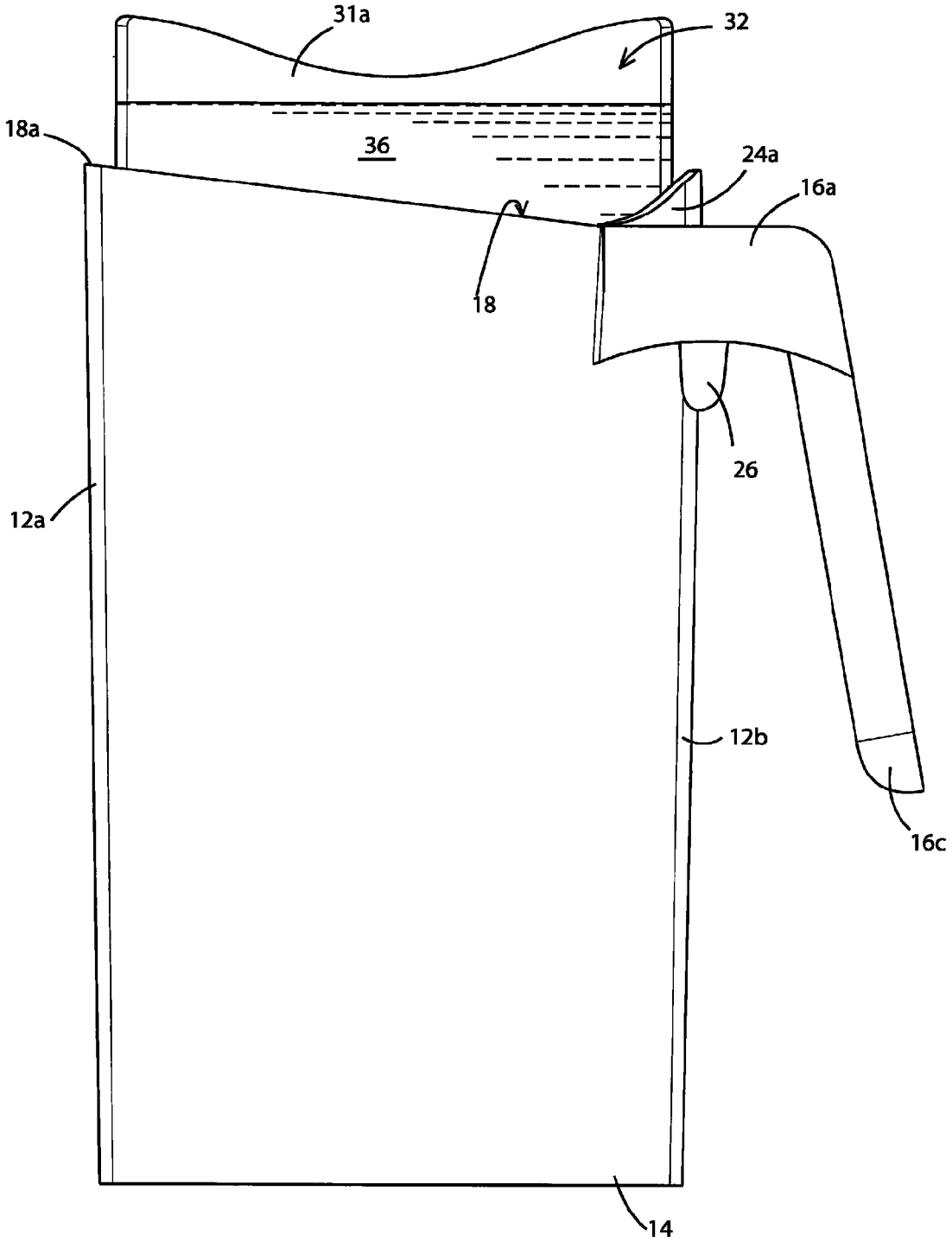
FIG. 9 is a left side view of the milk jug and milk bag of FIG. 8.

As shown in FIG. 6 and in accordance with another specific feature of the present invention, a retaining wall 26 is provided on jug 10 adjacent slit 30. Retaining wall 26 extends outwardly from an exterior surface of rear region 12*b* of peripheral wall 12 on a first side of slit 30 and terminates in the exterior surface of rear region 12*b* of peripheral wall 12 on a second side of slit 30. Retaining wall 26 also extends outwardly from the exterior surface of the peripheral wall a distance below a terminal end 30*a* of slit 30. Retaining wall 26 extends partially into top region 16*a* of handle 16. As shown in FIGS. 2, 3, 5, and 6, wall 26 and a portion of rear region 12*b* of peripheral wall 12 defines a chamber 28, the purpose of which will be described hereafter. Chamber 28 is in fluid communication with cavity 20 through slit 30. As best seen in FIG. 8, chamber 28 is open at the top of top region 16*a* of handle 16. Retaining wall 26 extends downwardly for a distance "D" from upper edges 25*a*, 25*b* of buttresses 24*a*, 24*b*. Wall 26 originates in peripheral wall 12 generally vertically beneath first buttress 24*a*, and curves in an arc before joining peripheral wall 12 generally vertically beneath second buttress 24*b*.

In accordance with yet another specific feature of the present invention, a generally V-shaped slit 30 originates between the upper ends of buttresses 24*a*, 24*b* and extends along rear region 12*b* of peripheral wall 12. Slit 30 is generally vertical in orientation, being disposed at right angles to bottom wall 14. Slit 30 extends for a distance along rear region 12*b* and terminates at a terminal end 30*b* (FIG. 7) that is proximate to where a bottom region of wall 26 joins rear region 12*b* of peripheral wall 12. As such, slit 30 has a length "D". Preferably, the length "D" is of about 1 to about 3 inches in length. Any other suitable length slit 30 may be utilized without departing from the scope of the present invention. Slit 30 preferably is of a sufficient length to adequately retain bag 32 therein and thereby, when milk is poured from jug 10, substantially prevent bag 32 from sliding toward front region 12*a* of jug or out of cavity 20 to a degree sufficient to cause milk to splash out of the hole in bag 32.

Figure 10:
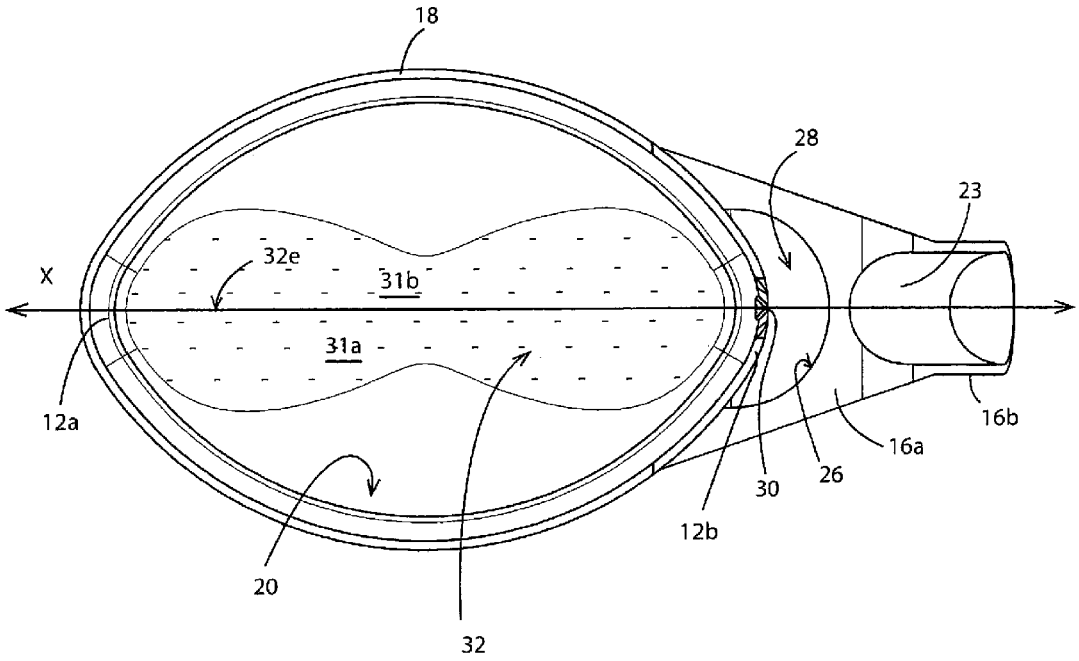
FIG. 10 is a top view of the milk jug and milk bag of FIG. 8.

Referring to FIGS. 8-15, jug 10 is used in the following manner. A filled and sealed bag of milk 32 is dropped into cavity 20 in jug 10. As is evident from FIGS. 8 and 9, bag 32 has a first side 31*a*, a second side 31*b*, a back region 32*a*, a back top corner 32*b*, a front region 32*c*, and a front top corner 32*d*. First and second sides 31*a*, 31*b* are joined together along at least a top seam 32*e* and define a compartment 33 (FIG. 14) in which a quantity of liquid, such as milk 36 is held. Bag 32 extends for a distance above rim 18 and above buttresses 24*a*, 24*b*. FIG. 10 also shows that bag 32 is disposed generally along the center line "X" of jug 10 and spaced inwardly from the interior surface of the peripheral wall 12.

Figure 11:
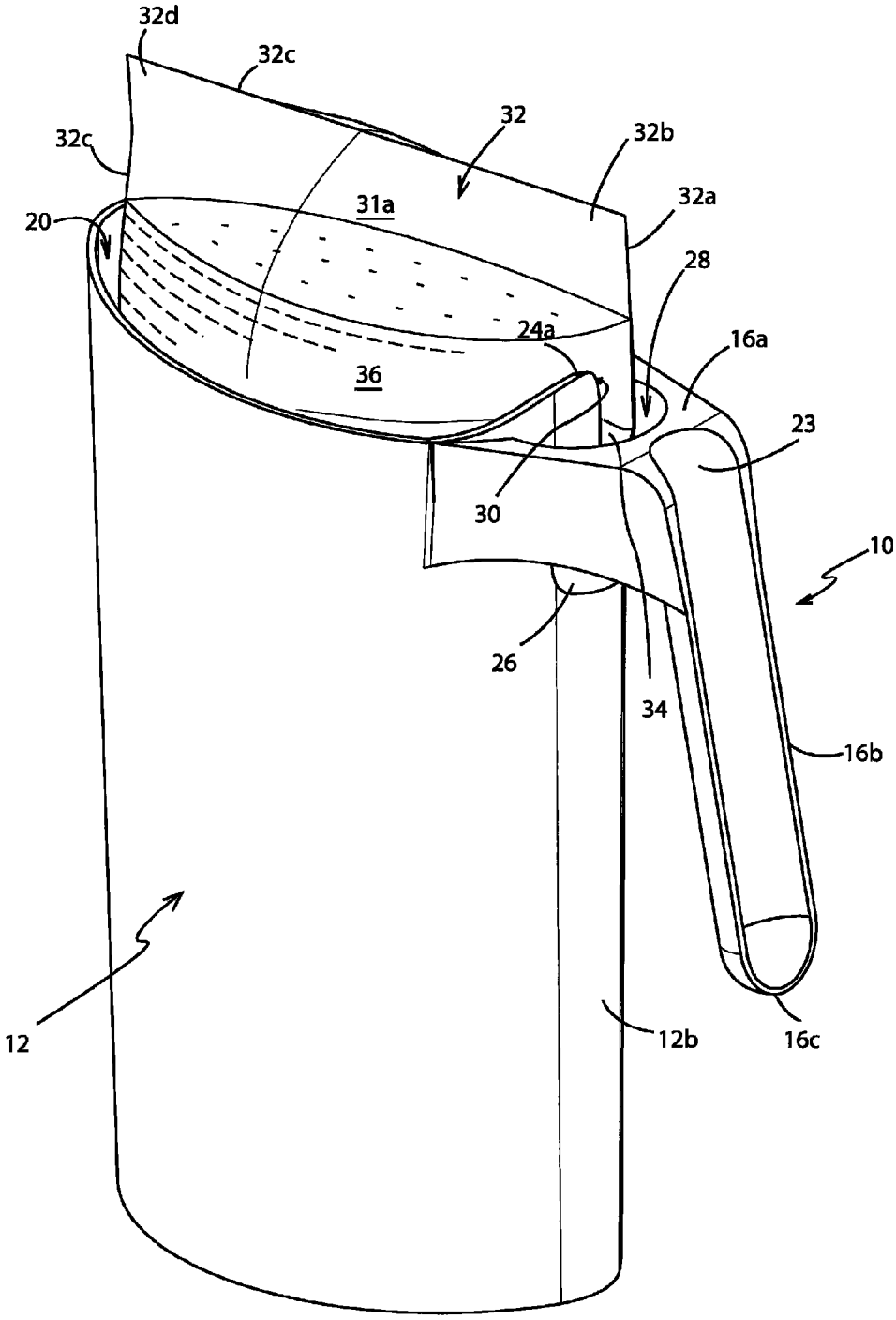
FIG. 11 is a rear perspective view of the milk jug with the milk bag secured in the slot.
Figure 12:
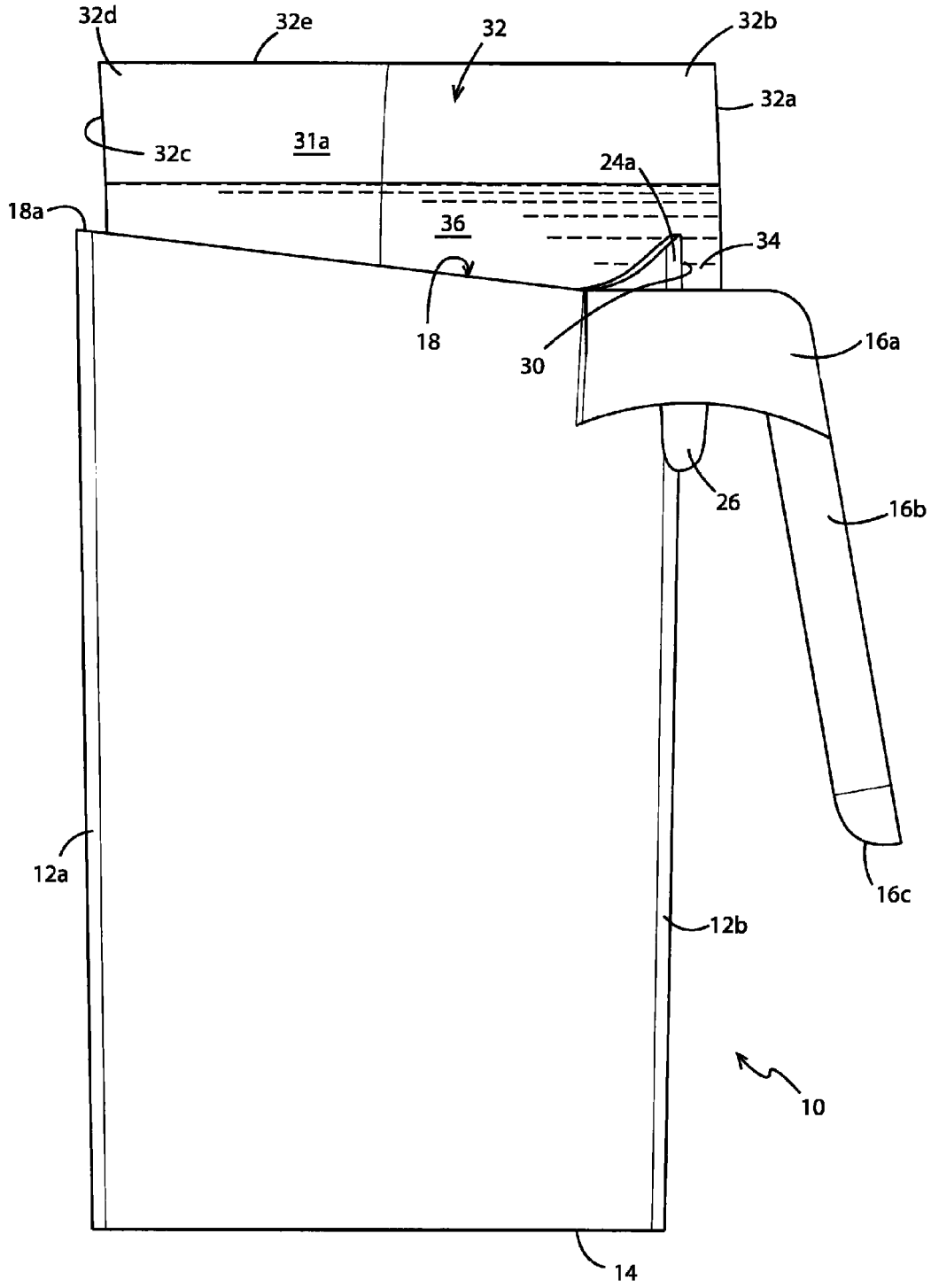
FIG. 12 is a left side view of the milk jug and milk bag shown in FIG. 10.
Figure 13:
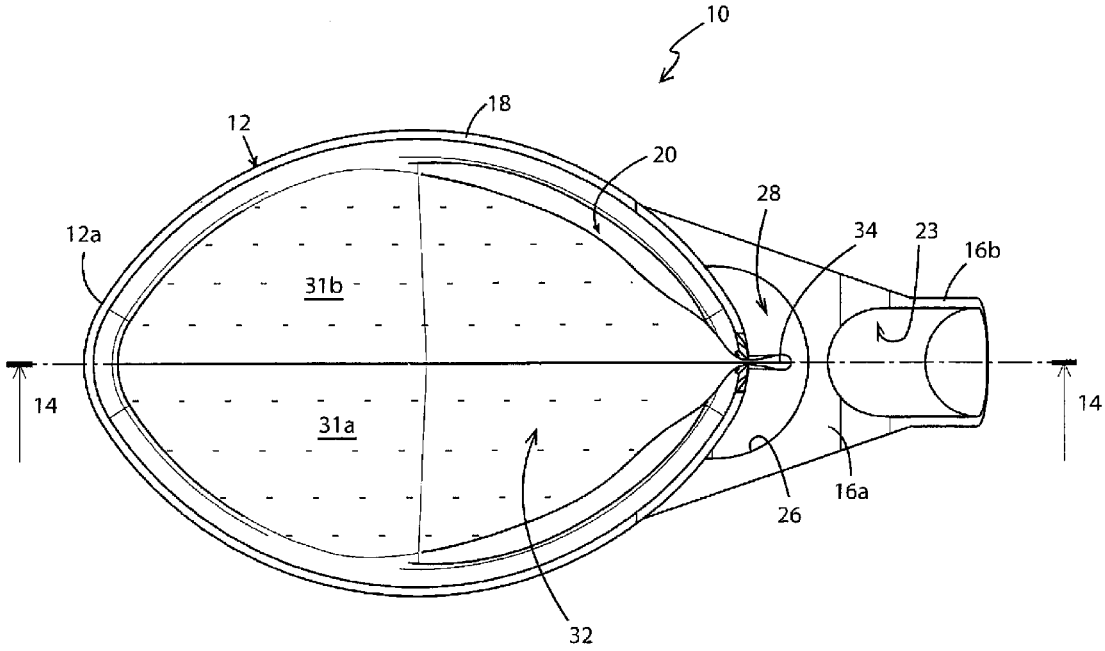
FIG. 13 is a top view of the milk jug and milk bag as shown in FIG. 10.
Figure 14:
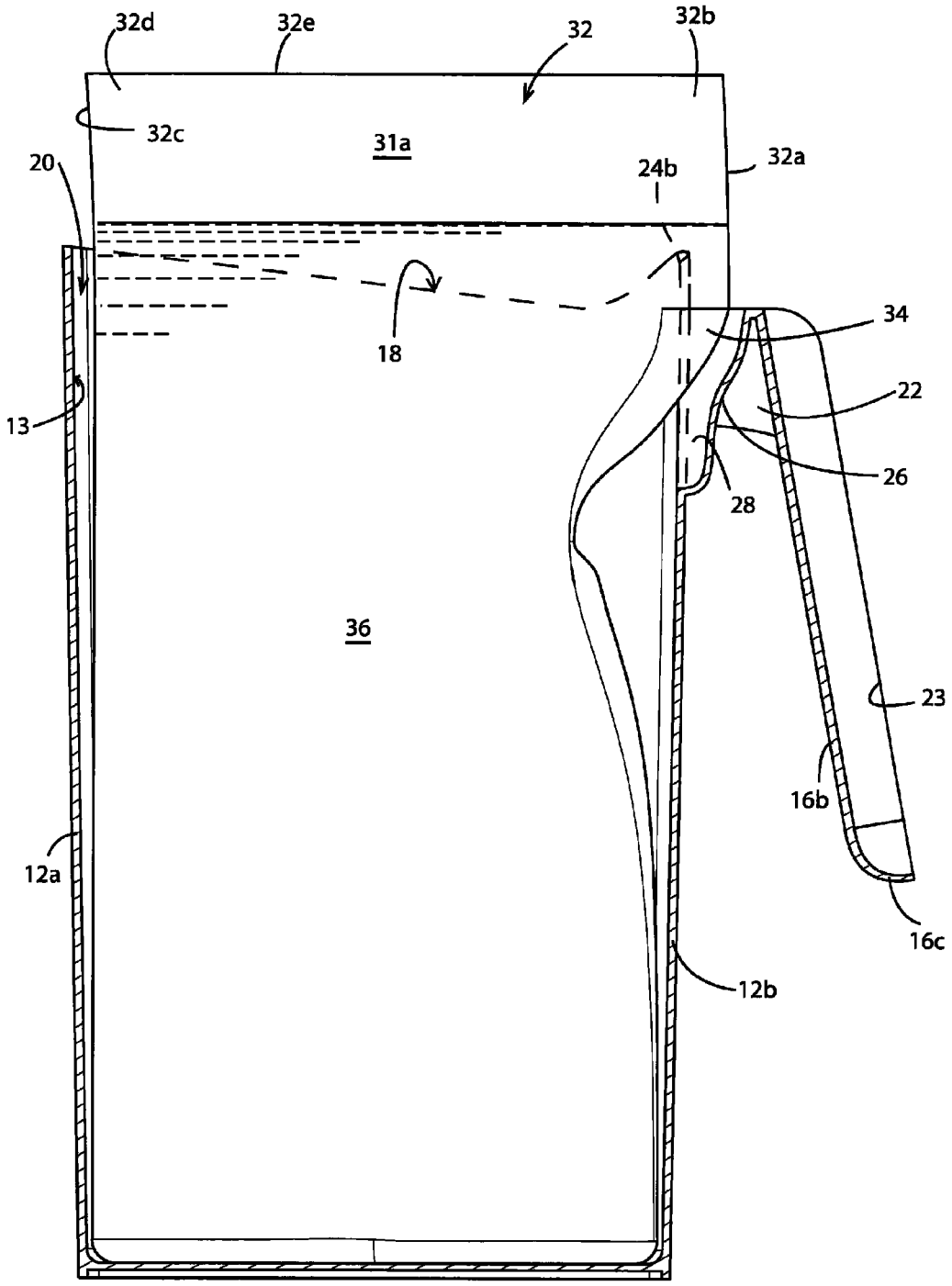
FIG. 14 is a left side cross-sectional view of the milk jug and milk bag taken through line 14-14 of FIG. 13.

FIG. 11 shows the manner in which jug 10 engages bag 32 to securely lock it into position in cavity 20. As is evident from this figure, a portion of bag 32 along back region 32*a* is engaged in slit 30 and that portion of bag 32, which is represented by the reference character 34, is seated in chamber 28 when engaged in slit 30. It is possible to engage portion 34 in slit 30 by pulling bag 32 slightly upwardly while grasping bag 32 near top rear corner 32*b* to shift the milk 36 within the interior of the bag toward front region 32*c*. The much-thinned portion 34 of bag 32 along back region 32*b* is then slid into the wider mouth 30*a* (FIG. 7) of slit 30. Bag 32 is then allowed to slide back into cavity 20 under force of gravity and comes to rest once again on bottom wall 14. It will be noted that the interior side surfaces of the gently curved buttresses 24*a*, 24*b* form the mouth 30*a* of slit 30. The gentle radius of curvature of buttresses 24*a*, 24*b* reduces the possibility that bag 32 will puncture during the engagement of the portion 34 of bag 32 in slit 30. Additionally, the gentle curved slopes of the interior side surfaces of buttresses 24*a*, 24*b* adjacent slit 30 channel the back region 32*b* of bag 32 into slit 30. Since jug 10, and at least peripheral wall 12 thereof, preferably is manufactured from polypropylene and this material is somewhat flexible, when the bag 32 is engaged in slit 30, the wall areas defining slit 30 are slightly flexible and tend to flex or move slightly apart relative to each other and then spring back to their original position to lock portion 34 of bag 32 in slit 30. Consequently, as bag 32 slides downwardly, the portion 34 thereof becomes wedged in the narrowing slit 30 by the flexing walls that define slit 30. Portion 34 is thereby frictionally and clampingly engaged in slit 30, thus locking bag 32 into the orientation shown in FIGS. 13 & 14. As may be seen from this figure, front region 32*c* of bag 32 is retained a short distance rearwardly away from the interior surface 13 of front region 12*a* of jug 10 when portion 34 is engaged in slit 30. Additionally, portion 34 of bag 32 extends rearwardly toward handle 16 and is seated in chamber 28 defined by retaining wall 26. This chamber 28 serves to catch any milk that may accidentally leak from portion 34. Milk may enter cavity 20 through slit 30 or may be poured out of the opening to chamber 28 in top region 16*a* of handle. FIG. 13 shows that when bag 32 is engaged in slit 30, the cross-sectional shape of bag 32 becomes somewhat changed and it fills more of the interior cavity 20 when viewed from above than was the case before portion 34 was engaged in slit 30.

Figure 15:
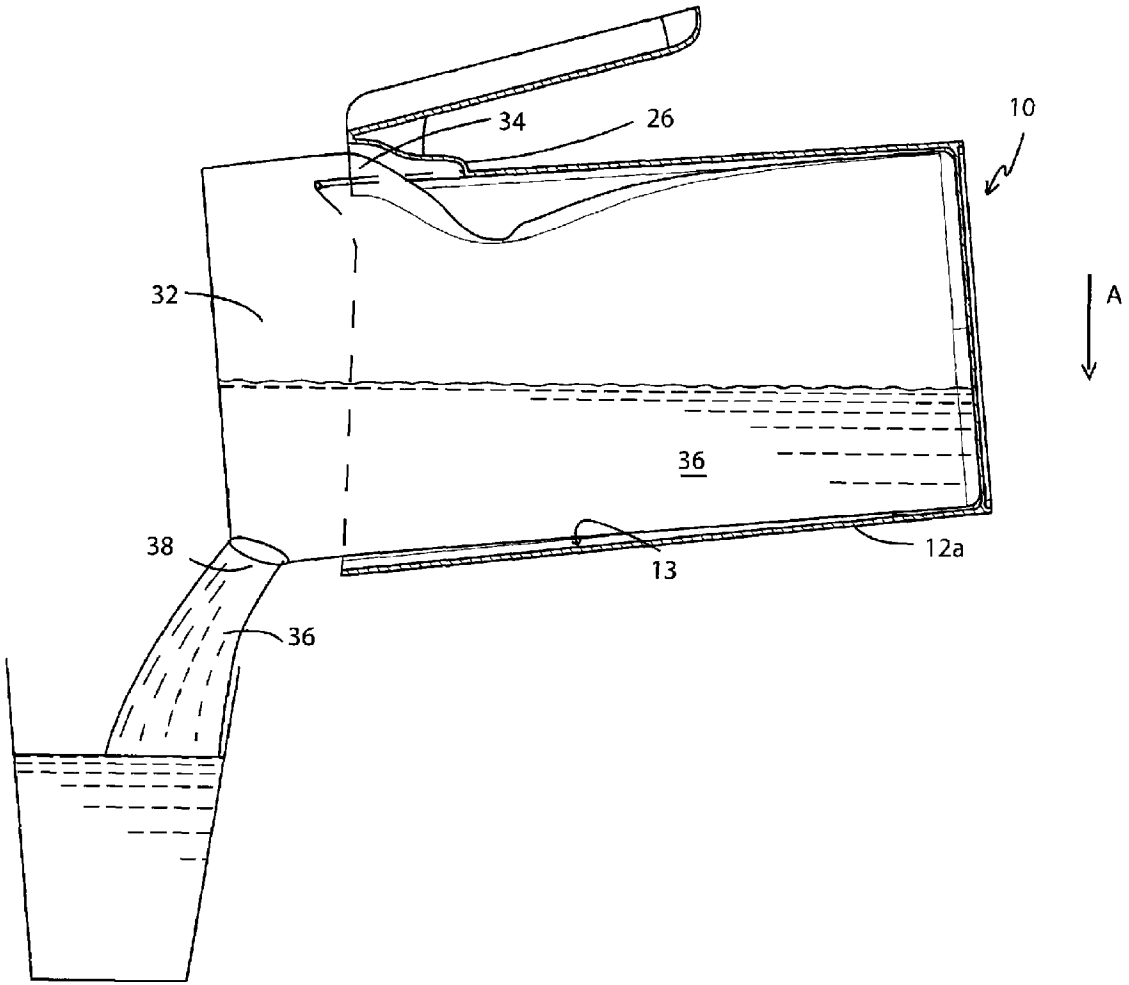
FIG. 15 is a left side view of the milk jug with the milk bag secured therein and showing the jug being tipped to pour milk from the bag.

FIG. 15 shows jug 10 being tipped to pour milk 36 through a hole 38 formed by cutting top front corner 32*d* (FIG. 13) off bag 32. As FIG. 15 illustrates, the portion 34 of bag 32 captured in slit 30 keeps bag 32 from sliding downwardly in the direction of arrow "A" and toward the interior surface 13 of front region 12*a* of jug 10 when in this tipped orientation. There is thus, substantially little to no tendency for milk to splash out of hole 38 as jug 10 is tilted. Furthermore, jug 10 keeps portion 34 firmly captured in slit 30 and prevents bag 32 from sliding out of the opening to cavity 20 when jug is tilted to pour milk 36 therefrom. Bag 32 stays engaged in slit 30 until the consumer grasps the top end of the empty bag 32 and pulls it upwardly to pull portion 34 out of the slit 30. A new bag (not shown) full of milk may then be inserted into cavity 20, engaging a portion thereof in slit 30 to keep back from sliding within cavity 20 as the jug is tilted to pour milk therefrom.

It will be understood that slit 30 may be configured to originate a distance downwardly from rim without departing from the scope of the present invention. Additionally, the retaining wall 26 may be provided within the perimeter of peripheral wall 12 and the slit may be formed in the retaining wall 26 instead of in the peripheral wall 12 without departing from the scope of the present invention. It will further be understood that the slit may be situated at another location along the peripheral wall or that more than one slit may be provided to capture portions of the bag therein. Still further, the slit may be configured to form an upside down V-shape so that the bag is pulled upwardly therein to engage the portion thereof within the slit.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention are an example and the invention is not limited to the exact details shown or described.

The invention claimed is:

1. A jug for retaining a plastic bag containing a liquid therein, said jug comprising:

a bottom wall;

a peripheral wall extending upwardly and outwardly from the bottom wall, wherein said peripheral wall includes a rim disposed a distance from the bottom wall;

a cavity bounded and defined by the bottom wall and the peripheral wall; and wherein the rim defines an opening through which the cavity is accessed, and wherein the cavity is adapted to receive the liquid-containing bag therein;

a handle extending outwardly from a rear region of the peripheral wall; and an engagement means provided on the iuq and adapted to engage the bag and to retain the bag within the cavity when the jug is tilted to pour the liquid therefrom, and wherein the engagement means comprises:

a slit defined in the peripheral wall; and wherein the slit is adapted to secure a portion of the plastic bag therein to substantially prevent the bag from moving toward an interior front surface of the peripheral wall when the jug is tilted; and a retaining wall originating in an exterior surface of the peripheral wall on a first side of the slit and terminating in the exterior surface of the peripheral wall on a second side of the slit; wherein the retaining wall extends outwardly from the exterior surface of the peripheral wall a distance below a terminal end of the slit, and wherein a chamber is defined between the retaining wall and the exterior surface of the peripheral wall and the chamber is in fluid communication with the cavity through the slit.

2. The jug as defined in claim 1, wherein the slit orginates in the rim of the peripheral wall and extends downwardly for a distance toward the bottom wall.

3. The jug as defined in claim 2, wherein the slit is substantially V-shaped along its length, with a wider portion of the slit being disposed proximate the rim of the peripheral wall and a narrower portion thereof being disposed a distance remote from the rim.

4. The jug as defined in claim 2, wherein the slit is substantially vertically oriented and is disposed substantially at right angles relative to the bottom wall of the jug.

5. The jug as defined in claim 3, further including a first buttress formed in the rim adjacent the wider portion of the slit, and wherein the first buttress includes a curved upper edge and an interior side surface adjacent the slit and adapted to guide the portion of the bag into the slit.

6. The jug as defined in claim 5, further comprising a second buttress formed in the rim adjacent the wider portion of the slit, wherein the second buttress includes a curved upper edge and an interior side surface adjacent the slit, and wherein the first and second buttresses are on opposite sides of the wider portion of the slit.

7. The jug as defined in claim 6, wherein the curved surface and the interior side surface of each of the first and second buttresses are substantially continuous with each other, and wherein each of the interior side surfaces angle downwardly toward the slit.

8. The jug as defined in claim 1, wherein at least the peripheral wall of the jug is molded from a flexible material and wherein the peripheral wall in the region of the slit is adapted to flex slightly when engaging the plastic bag of liquid therein.

9. In combination:

a plastic bag having a first side and a second side joined to ether along at least a top seam and having a front region and a rear region extending downwardly from the top seam and meeting the top seam at a front top corner and a back top corner respectively, an interior compartment defined by the first and second side of the bag, said interior compartment being adapted to retain a quantity of liquid therein;

a jug for retaining and supporting the plastic bag, said jug comprising:

a bottom wall;

a peripheral wall extending upwardly and outwardly from the bottom wall; wherein said peripheral wall includes an uppermost rim disposed a distance from the bottom wall, a front region and a rear region;

a cavity bounded and defined by the bottom wall and the peripheral wall; and wherein the rim defines an opening through which the cavity is accessed; and wherein the plastic bag is received in the cavity such that a top end of the plastic bag extends for a distance above the rim and the front region of the plastic bag is proximate the front region of the jug and the back region of the plastic bag is proximate the rear region of the jug;

a handle extending outwardly from a rear region of the peripheral wall; and an engagement means provided on the jug and configured to engage the rear region of the bag and to retain the bag within the cavity when the jug is tilted to pour the liquid therefrom; and wherein the engagement means comprises:

a slit defined in the peripheral wall of the jug, said slit originating in the rim and extending downwardly for a distance; and wherein a portion of the plastic bag is receivable in the slit and is thereby locked against movement toward a front interior surface of the front region of the peripheral wall when the jug is tilted; and a retaining wall originating in an exterior surface of the peripheral wall on a first side of the slit and terminating in the exterior surface of the peripheral wall on a second side of the slit; and wherein a chamber is defined between the retaining wall and the peripheral wall and the chamber is in fluid communication with the cavity through the slit.

10. The combination as defined in claim 9, wherein the portion of the plastic bag is wedged into the slit and is retained therein by friction.

11. The combination as defined in claim 9, wherein the slit is substantially V-shaped along its length, with a wider portion of the slit being disposed proximate the rim of the peripheral wall and a narrower apex thereof being disposed a distance remote from the rim.

12. The combination as defined in claim 11, wherein the slit is substantially vertically oriented and is disposed substantially at right angles relative to the bottom wall of the jug.

13. The combination as defined in claim 12, further including:

a first buttress formed in the rim adjacent a first side of the wider portion of the slit;

a second buttress formed in the rim adjacent a second side of the wider portion of the slit, and wherein each of the first and second buttresses has a curved upper edge and an interior side surface that is continuous with the curved upper edge associated therewith, and wherein each of the interior side surfaces angles downwardly toward the slit.

14. The combination as defined in claim 9, wherein at least the peripheral wall of the jug is made from a flexible material and wherein the peripheral wall in the region of the slit flexes slightly when engaging the plastic bag of liquid therein.

15. A method of retaining a plastic bag containing a liquid in a jug used for dispensing the liquid; wherein the method includes the steps of:

grasping a top end of the plastic bag;

sliding a bottom end of the grasped plastic bag into a cavity in the jug;

sliding a portion of a rear region of the plastic bag into a slit formed in a rear region of a peripheral wall of the jug which defines the cavity; and wedging the portion of the rear region of the plastic bag in the slit; and retaining the wedged portion of the plastic bag in a chamber defined between a retaining wall and the peripheral wall.

16. The method as defined in claim 15, further comprising the step of:

sliding the portion of the rear region of the plastic bag from a wider area of the slit to a narrower area of the slit.

17. The method as defined in claim 16, further comprising the step of:

flexing sections of the peripheral wall that define the slit to permit the plastic bag to slide down the slit.

* * * * *

UNITED STATES PATENT AND TRADEMARK OFFICE

CERTIFICATE OF CORRECTION

PATENT NO. : 8,651,332 B2
APPLICATION NO. : 13/369891
DATED : February 18, 2014
INVENTOR(S) : Adam Pauze et al.

It is certified that error appears in the above-identified patent and that said Letters Patent is hereby corrected as shown below:

In the Claims:

Column 5, line 47 (Claim 1) "provided on the iuq" should be changed to --provided on the jug--

Column 6, lines 31-32 (Claim 9) "joined to ether along" should be changed to --joined together along--

Signed and Sealed this
Twenty-ninth Day of April, 2014

Michelle K. Lee

Michelle K. Lee
*Deputy Director of the United States Patent and Trademark Office*